United States Patent [19]

Emmerich

[11] 4,219,712

[45] Aug. 26, 1980

[54] HIGH COMPRESSION PUFFER CIRCUIT INTERRUPTER

[75] Inventor: Werner S. Emmerich, Churchill Borough, Pa.

[73] Assignee: Westinghouse Electric Corp., Pittsburgh, Pa.

[21] Appl. No.: 902,009

[22] Filed: May 1, 1978

[51] Int. Cl.[2] ..... H01H 33/70

[52] U.S. Cl. ..... 200/148 A; 200/148 F

[58] Field of Search ..... 200/148 R, 148 A, 148 B, 200/148 C, 148 D, 148 E, 148 F, 148 G, 148 H, 148 J, 148 BV

[56] References Cited

U.S. PATENT DOCUMENTS

| | | | |
|---|---|---|---|
| 3,171,937 | 3/1965 | McKeough | 200/148 B |
| 4,139,753 | 2/1979 | Cromer et al. | 200/148 A |

*Primary Examiner*—J. V. Truhe
*Assistant Examiner*—Morris Ginsburg
*Attorney, Agent, or Firm*—L. P. Johns

[57] ABSTRACT

A circuit interrupter characterized by a pair of separable contacts which establish an arc upon separation, means for directing a blast of arc interrupting gas into the zone between the separating contacts to extinguish the arc and comprising a cylinder movable within a surrounding casing, a piston movably mounted in the cylinder and pressurized fluid means cooperating with the piston to compress and push the interrupting gas from the cylinder to said zone.

4 Claims, 3 Drawing Figures

OPEN POSITION

HIGH COMPRESSION PUFFER CIRCUIT INTERRUPTER

CROSS-REFERENCE TO RELATED APPLICATION

This invention is related to the application Ser. No. 902,008, filed May 1, 1978 by Werner S. Emmerich.

BACKGROUND OF THE INVENTION

1. Field of the Invention

This invention relates to a high-speed high-pressure puffer type circuit interrupter, and more particularly, it pertains to a pressure system for use in the repetitive adiabatic compression of the interrupting gas, such as for instance, sulfur hexafluoride ($SF_6$).

2. Description of the Prior Art

The puffer concept has been used in the past for power circuit breakers principally as a cheap and simple substitute for a two-pressure system at relatively moderate ratings. Recently it has been demonstrated that puffers can be extended to unexpectedly high ratings. Heretofore it had not been anticipated that a buffer could be superior to a conventional two-pressure breaker in certain respects.

Generally, a high pressure of an arc extinguishing gas such as $SF_6$ is necessary because the higher the pressure the quicker the arc extinction. However, attempting to store $SF_6$ at high pressures causes liquefaction at lower temperatures. Prior attempts to heat $SF_6$ to prevent liquefaction have proven costly. Accordingly, the base pressure of $SF_6$ gas in a puffer is usually maintained no higher than approximately 70 psi in order to avoid the necessity for heaters. Since the interruption capability of the breaker increases with pressure differential, it is desirable to create as high an upstream pressure as possible, for instance, as high as 600–800 psi.

In the conventional two-pressure system the upstream pressure is limited by practical considerations of the heaters to approximately 225 psig. In the puffer there is no such limitation since the gas is compressed adiabatically. There are some practical upper limits to adiabatic compression since the interrupting pressure must be developed in approximately 10 milliseconds for a two-cycle breaker. Energy to produce the compression for several consecutive operations must be stored in the device somewhere. Pressures above 800–1000 psi become non-competitive from a pressure vessel code point of view.

SUMMARY OF THE INVENTION

It has been found in accordance with this invention that problems inherent in the puffer-type circuit interrupter may be overcome by providing a circuit interrupter comprising an elongated insulating casing having opposite end portions, a stationary contact disposed at one end portion, a movable contact within the casing and separable from the stationary contact to establish an arc, mounting means extending from the other end portion for mounting and moving the movable contact, means for directing a blast of an interrupting gas into the zone between the separating contacts to extinguish an arc and comprising a puffer cylinder, the cylinder being movable longitudinally of the casing, a piston or diaphragm movably mounted on the mounting means inside of the puffer cylinder, the piston having an annular shape including an outer periphery movably mounted on the cylinder and including an aperture through which the mounting means extend and the piston being in gas-tight slidable movement with the mounting means and the cylinder, pressurized fluid means cooperating with the piston to compress and push and interrupting gas from the cylinder to said zone, the pressurized gas means comprising a pneumatic system including telescoping gas conducting conduits operatively connected to the puffer cylinder.

The advantage of a device of this invention is that a primary high-pressure gas system, typically air, can provide the required energy reservoir to compress $SF_6$ gas to the desired pressure by means of a low inertia system, such as a lightweight diaphragm or piston arrangement. The speed of operation is limited principally by valving. Thus, extremely high transient pressures occur during the interruption process.

DESCRIPTION OF THE PREFERRED EMBODIMENTS

Figure 1:
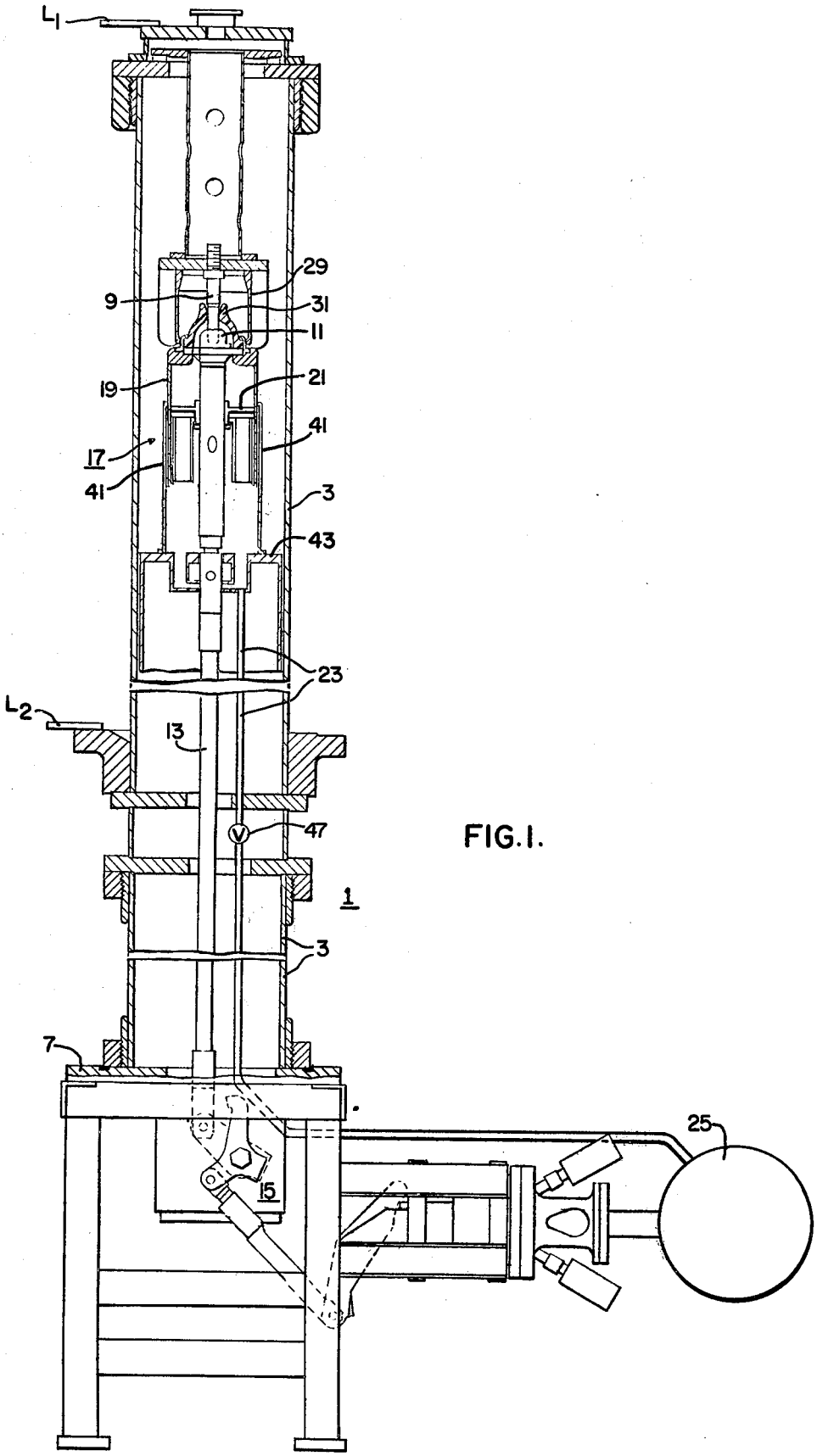
FIG. 1 is a vertical sectional view of a compressed-gas circuit interrupter showing the contacts in the closed-circuit position.

In FIG. 1 a high-voltage compressed-gas circuit interrupter is generally indicated at 1 and it comprises an elongated tubular housing for casing 3 which is preferably cylindrical and which is comprised of an electrically insulating material such as glass reinforced epoxy. The upper end of the casing 3 is closed by a top cover and the lower end is closed by a bottom cover 7. The circuit interrupter 1 also includes a stationary contact 9, a movable contact 11, means for moving the movable contact and including an elongated rod 13, and rod actuating means generally indicated at 15. The circuit interrupter 1 also comprises means for directing a blast of arc interrupting gas into the zone between the separating contacts and generally indicated at 17 which means includes a puffer cylinder 19, a floating piston or diaphragm 21, a gas conduit 23, and a gas source or air supply 25.

The prior art includes U.S. Pat. No. 3,171,937, issued to D. H. McKeough on Mar. 2, 1965 which is entitled "Arc-Extinguishing Structure For Compressed-Gas Circuit Interrupter", which among other things discloses a two-gas system for extinguishing arcs occurring between separating contacts. Compressed air is used for evacuating a puffer cylinder of extinguishing gas ($SF_6$) which cylinder is fixedly mounted within the outer casing of the circuit interrrupter. Where higher speeds are desired for extinguishing an arc and particularly for flooding the arc zone with even greater amounts of extinguishing gas, it is believed that the fixed puffer cylinder limits the volume and speed of the gas that could otherwise be delivered to the arc zone.

Figure 2:
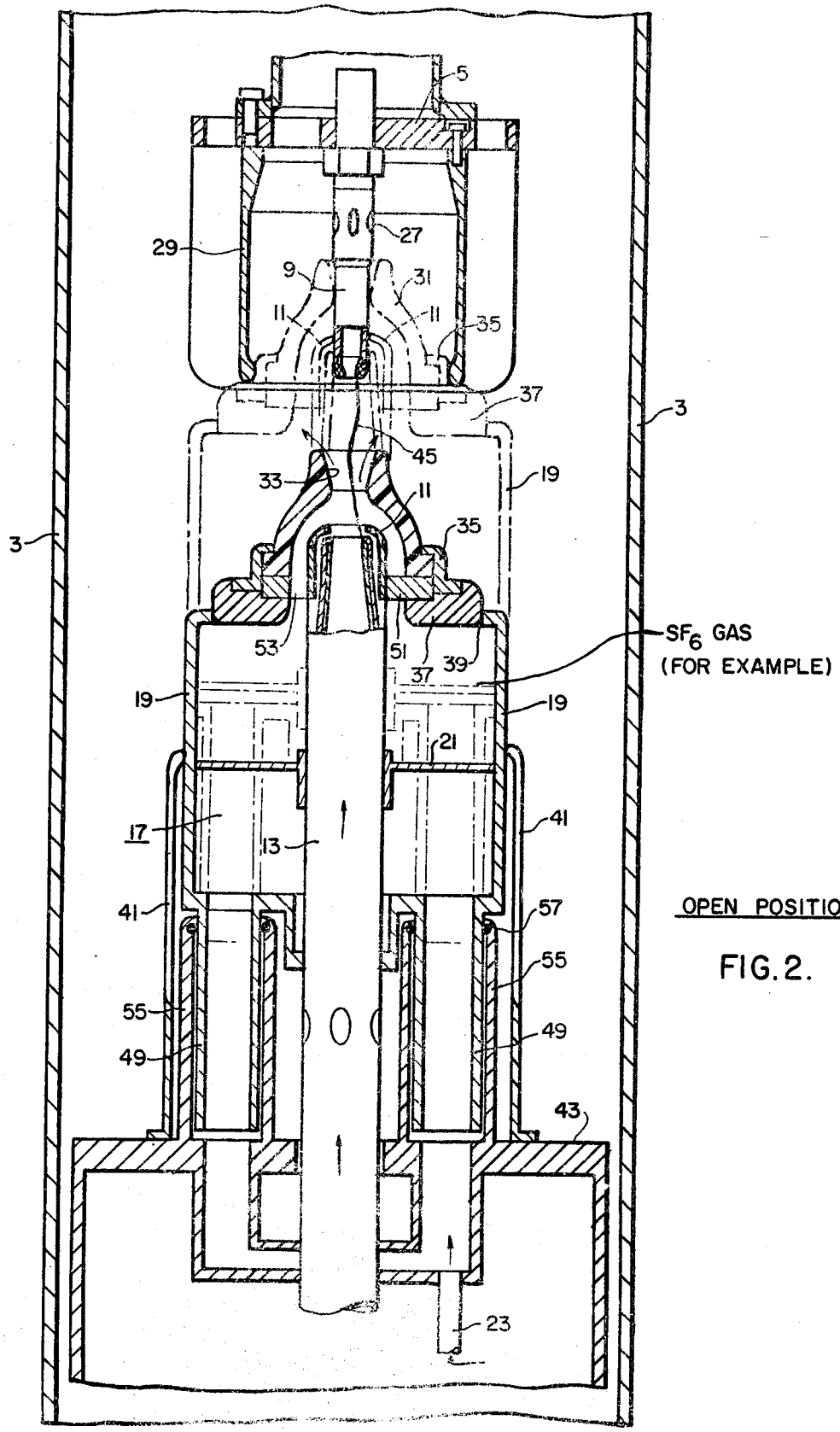
FIG. 2 is an enlarged fragmentary vertical sectional view of the contacts in the open-circuit position.

As shown in FIG. 2 the stationary contact 9 is supported from the top cover 5 and is disposed substantially axially of the casing 3. The stationary contact 9 is preferably tubular and includes vent apertures 27 in the upper portion thereof. Surrounding the contact 9 is a cylindrical member or skirt 29 of electrically conductive material which supplements the contact 9 in carrying the current load. Accordingly, the stationary contact including the contacts 9 and 29 are fixedly mounted at the upper end of the circuit interrupter 1.

The movable contact 11, being disposed at the upper end of the rod 13, is comprised of a plurality of resilient contact fingers 11 to form a tubular contact structure which engages the lower end portion of the stationary contact 9 when the contacts are closed as shown in the broken-line positions in FIG. 2.

Surrounding the movable contact 11 is a shroud 31 of insulating material having an orifice 33 through which the stationary contact 9 extends. The shroud 31 is secured in place by an annular clamp 35 which in turn is secured to an end plate 37. The puffer cylinder 19 is secured at its upper end to the end plate 37 in a suitable manner such as by an annular weld 39. In the closed position of the contacts the skirt 29 engages the clamp 35 which together with the end plate 37 are comprised of electrically conductive material.

The circuit through the circuit interrupter 1 extends from a line terminal connection $L_1$ at the upper end through the top cover, the stationary contacts 9, 29, the movable contact 11, the clamp 35, the end plate 37, the cylinder 19, a plurality of tapping fingers 41, a base 43, and a line terminal connection $L_2$.

In accordance with this invention the assembly of the cylinder 19 and the movable contact 11 move simultaneously when the rod 13 is actuated by the rod actuating means 15 which in turn operates in response to an overcurrent. As the movable contact assembly moves from the closed-circuit (broken-line) position to the open position (FIG. 2), an electric arc 45 usually occurs between the stationary and movable contacts 9, 11. Simultaneously, a valve 47 (FIG. 1) in the gas conduit 23 opens the conduits whereby compressed gas, such as air, is transmitted to a plurality of telescopically fitting members 49 leading to the lower part of the puffer cylinder 19. The floating piston or diaphragm 21 separates the compressed air entering the cylinder 19 from the arc interrrupting gas such as $SF_6$ in the upper portion of the cylinder. The compressed air drives the piston 21 upwardly to force the $SF_6$ gas through the orifice 33 of the nozzle 31, whereby the arc 45 is extinguished. As the $SF_6$ gas leaves the zone of the orifice 33 to extinguish the arc 45, it moves into the ambient atmosphere surrounding the operating portions of the circuit interrupter and within the casing 3.

Moreover, in accordance with this invention the cylinder 19 and the movable contact 11, being interconnected through spaced radial members or a spider 51 move together with the rod 13. As a result the compressed air has the sole purpose of moving the piston 21 to evacuate the $SF_6$ from the interior of the upper cylinder 19 through apertures 53 formed by the spider 51 and thence through the nozzle orifice 33 in the zone of the arc 45. Moreover, as the cylinder 19 lowers to the open position, the telescopic members 49 move into their surrounding telescopic members 55 which are sealed together by gasket means or O-rings 57. Thus, the downward movement of the cylinder augments the pressure of the air and which is used for operating the valve 47. Suffice it to say, the cylinder 19 moves by means other than the air which in turn has the sole purpose of driving the $SF_6$ into the orifice 33 for extinguishing the arc 45.

Figure 3:
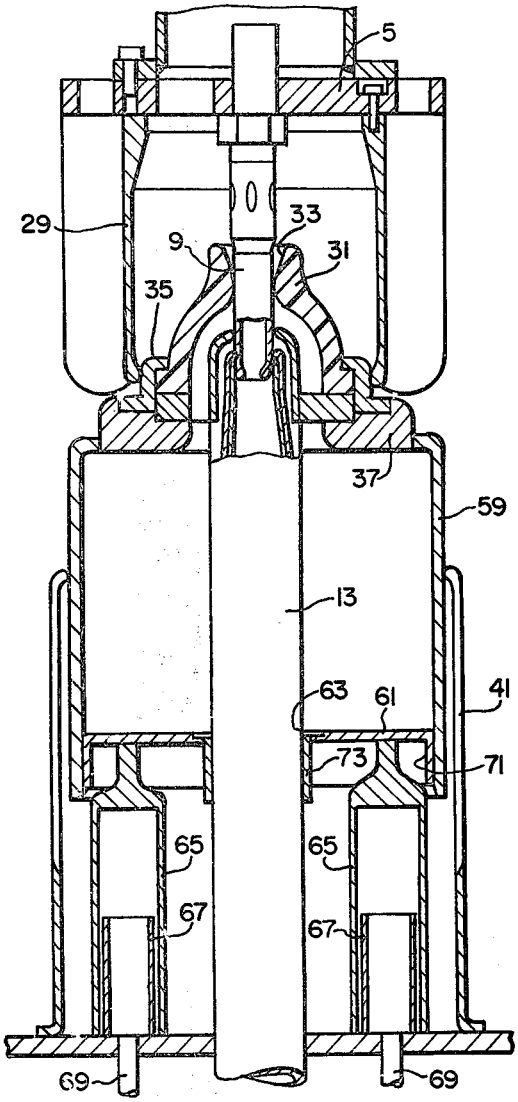
FIG. 3 is a fragmentary vertical sectional view of another embodiment of the circuit interrupter, showing the contacts in the closed-circuit position.

Another embodiment of the invention is shown in FIG. 3 in which similar numerals refer to similar parts. This embodiment includes a cylinder 59 extending downwardly from the end plate 37 in a manner similar to the puffer cylinder 19 of FIG. 2. The lower end of the cylinder 59 is open and a floating piston or diaphragm 61 is movably mounted therein. The piston 61 has a central opening 63 so that the piston is slidable longitudinally of the rod 13 within the cylinder 59. The interior of the cylinder 59 between the end plate 37 and the piston 61 is filled with an arc interrupting gas, such as $SF_6$, which is expelled through the upper end of the cylinder when the piston 61 is raised in a manner similar to that shown in FIG. 2.

In accordance with this invention means for raising and lowering the piston 61 are also provided and comprise a plurality of spaced fluid drive, means such as pneumatic cylinders 65, the upper ends of which are attached to the underside of the piston 61. The lower portions of the cylinders 65 are mounted on air conduits 67. The cylinders 65 and the conduits 67 are preferably telescopically disposed in an airtight manner. Pressurized air is introduced into the cylinders 65 through openings 69. Conversely, when the piston 61 is lowered the opening 69 may serve as a return port, whereby a partial vacuum created thereby in the cylinder 59 draws the interrupting gas $SF_6$ into the cylinder.

The outer periphery of the piston 61 includes a gasket 71 and the inner periphery surrounding the aperture 63 is likewise provided with a sliding gasket 73.

Accordingly, the high-compression puffer-type circuit interrupter of this invention comprises advantages over certain interrupters of prior art construction. One advantage is that the puffer cylinder is mounted on the rod on which the movable contact is mounted whereby the cylinder moves with the contact independently of another moving means such as compressed air and separately of the surrounding casing 3. Thus, the compressed air is available solely for compressing the interrupting gas such as $SF_6$ to provide a larger gas force for extinguishing an arc. Second, the compressed gas flows through an aerodynamically favorable passage from the cylinder to the electrode-arc area to provide a direct interruption of the arc. Third, the pressurized gas or air operates only the piston and not the electrode assembly so that the electrode movement is independently controlled through an unspecified operating mechanism outside of the puffer enclosure, thereby providing flexibility to activate either independently of the other.

Fourth, the electrode is closed by external means and the piston is moved by an ambient $SF_6$ pressure which is preferably maintained at 70–80 psi at all times and independently of other mechanical means such as springs which are previously compressed during the opening operation. The extinguishing gas ($SF_6$) flows into the center of the movable electrode assembly and out through orifices in the electrode rod to return to the plenum or ambient atmosphere of the interrupter.

Finally, the puffer-type circuit interrupter of this invention requires no arc catcher as is required by existing circuit interrupters.

What is claimed is:

1. A high compression puffer-type circuit interrupter comprising an elongated insulating casing having opposite end portions, a stationary contact disposed at one end portion, a movable contact within the casing and separable from the stationary contact to establish an arc, mounting means extending from the opposite end portion for mounting and moving the movable contact, means for directing a blast of an interrupting gas into a zone between the separating contacts to extinguish an arc and comprising a puffer cylinder, the cylinder being movable longitudinally of the casing, a piston slidably mounted on the mounting means inside of the puffer cylinder, the piston being in gas-tight contact with the mounting means and the puffer cylinder and dividing the cylinder into first and second gas chambers, pressurized fluid means cooperating with the piston to compress and push an interrupting gas from the cylinder to said zone, and the piston being a rigid floating partition between the interrupting gas and the pressurized fluid means in the first and second gas chambers.

2. The circuit interrupter of claim 1 in which the piston has an annular shape including an outer periphery slidable along the cylinder and including an aperture through which the mounting means extends.

3. The circuit interrupter of claim 2 in which the pressurized fluid means comprises fluid drive means for moving the piston against the interrupting gas.

4. The circuit interrupter of claim 3 in which the fluid drive means comprises a pneumatic system including telescoping gas conducting conduits operatively connected to the puffer cylinder.

* * * * *